US006106280A

United States Patent [19]

Kanno

[11] Patent Number: 6,106,280

[45] Date of Patent: Aug. 22, 2000

[54] STRUCTURE FOR PREVENTING DETACHMENT OF LIGHTER NOZZLE CAP

[75] Inventor: Minoru Kanno, Shizuoka-ken, Japan

[73] Assignee: Tokai Corporation, Tokyo, Japan

[21] Appl. No.: 09/201,976

[22] Filed: Dec. 1, 1998

[30] Foreign Application Priority Data

Dec. 3, 1997 [JP] Japan ..... 9-332879

[51] Int. Cl.[7] ..... F23Q 2/34

[52] U.S. Cl. ..... 431/344; 431/277

[58] Field of Search ..... 431/144, 276, 431/277, 310, 255, 142, 143, 344

[56] References Cited

U.S. PATENT DOCUMENTS 3,814,572 6/1974 Nitta ..... 126/276
5,417,563 5/1995 Cirami ..... 126/277
5,427,523 6/1995 Yiu ..... 126/277
5,624,254 4/1997 Kee ..... 126/277
5,743,725 4/1998 Chan ..... 126/276

*Primary Examiner*—Ira S. Lazarus
*Assistant Examiner*—Sara Clarke
*Attorney, Agent, or Firm*—BakerBotts, LLP

[57] ABSTRACT

A structure is provided for preventing detachment of a lighter nozzle cap in a lighter having a main lighter body, a burner located on top of the main lighter body for burning fuel to produce a flame, an operation member located on top of the main lighter body for lighting the burner and a nozzle cap for covering a zone surrounding the burner from above. The structure includes a pair of posts projecting from the top of the main lighter body, each post being formed with a socket, a pair of detachment preventing catches provided one on either side wall of the nozzle cap to be engageable with the sockets, and retaining portions provided at portions of the side walls near the catches for engaging with an upper inner edge of the main lighter body to prevent spreading deformation of the side walls.

3 Claims, 3 Drawing Sheets

STRUCTURE FOR PREVENTING DETACHMENT OF LIGHTER NOZZLE CAP

BACKGROUND OF THE INVENTION

1. Field of the Invention

This invention relates to a structure in a lighter equipped with a nozzle cap for covering a gas jetting nozzle or other burner member for burning fuel to produce a flame, particularly to a structure for preventing detachment of the nozzle cap.

2. Description of the Related Art

The gas cigarette lighter is a typical lighter. This is a device equipped with a jetting nozzle, serving as a burner, and an igniter. It produces a flame by jetting fuel gas from the jetting nozzle and igniting the jetted fuel gas with the igniter. A nozzle cap is attached to the top of the main lighter body so as to surround the jetting nozzle. The nozzle cap protects the jetting nozzle and internal members such as the flame adjuster ring from both damage and tampering. It also provides a heat insulting effect that prevents the heat of the flame from being conducted to the main lighter body.

One conventional structure for attaching the nozzle cap to the main lighter body will be described. The nozzle for jetting the fuel gas (the burner) is located at the top front of the main lighter body and an operation member for effecting the fuel jetting and ignition operations is disposed at the top rear to be vertically movable. A side wall rises from either side of the top middle. Each wall forms a support post having a socket-like indentation in its side. The nozzle cap has a flame hole in its ceiling and is structured to prevent outward spreading of its side walls. This is achieved by forcibly forming it into an elliptical shape by use of a press and providing the ceiling both with a partition and with catches for engaging the operation member or a portion of a striker wheel mechanism.

The nozzle cap attached by this structure may, however, detach if the lighter is accidently dropped onto a hard surface during use. This can happen if the lighter lands on the curved portion of the nozzle cap ceiling because a strong impact on this portion may disengage the sockets and the catches and cause the side walls to spread.

Moreover the user can detach the nozzle cap fairly easily by using a tool or the like to spread its side walls so as to disengage the sockets and catches. Subsequent reattachment is also possible.

When the nozzle cap is removed from the main lighter body, the preset flame length can be changed by adjusting the nozzle mechanism or modifying the burner structure. This can lead to a mishap if the flame length is set too long.

The object of this invention is therefore to provide a structure for preventing detachment of the lighter nozzle cap that reliably prevents lateral spreading of the nozzle cap.

SUMMARY OF THE INVENTION

For overcoming the foregoing problems, this invention provides a structure for preventing detachment of a lighter nozzle cap in a lighter including a main lighter body, a burner located on top of the main lighter body for burning fuel to produce a flame, an operation member located on top of the main lighter body for lighting the burner and a nozzle cap for covering a zone surrounding the burner from above, the structure comprising a pair of posts projecting from the top of the main lighter body, each post being formed with a socket, a pair of detachment preventing catches provided one on either side wall of the nozzle cap to be engageable with the sockets, and retaining portions provided at portions of the side walls near the catches for engaging with an upper inner edge of the main lighter body to prevent spreading deformation of the side walls.

The nozzle cap is attached to the top of the main lighter body by bringing the retaining portions on the side walls of the nozzle cap into engagement with the upper inner edge of the main lighter body and then deforming and spreading the walls of the nozzle cap to bring the catches into engagement with the sockets.

In a preferable configuration of the structure, edges of the side walls of the nozzle cap are bent to form inwardly projecting flanges and the retaining portions are provided at lower ends of the flanges to extend downward inside the upper end of the main lighter body, engagement between the retaining portions and the upper inner edge of the main lighter body preventing spreading deformation of the nozzle cap.

In the structure for preventing detachment of a lighter nozzle cap according to the invention, the retaining portions provided on the nozzle cap engage with the inside of the upper end of the main lighter body. The engagement is therefore difficult to release from the exterior. An attempt to force the nozzle cap off with a tool or the like leads to breakage of either the nozzle cap or the main lighter body and makes it impossible to reattach the nozzle cap. Use of the lighter with the flame length or the like improperly adjusted is therefore prevented. Moreover, owing to the substantial separation between the points where the retaining portions engage with the main lighter body and the crown of the lighter, the nozzle cap deforms only slightly even when the lighter collides head first with a hard surface. The nozzle cap is therefore unlikely to detach when the lighter is accidentally dropped.

DESCRIPTION OF THE PREFERRED EMBODIMENT

Figure 1A:
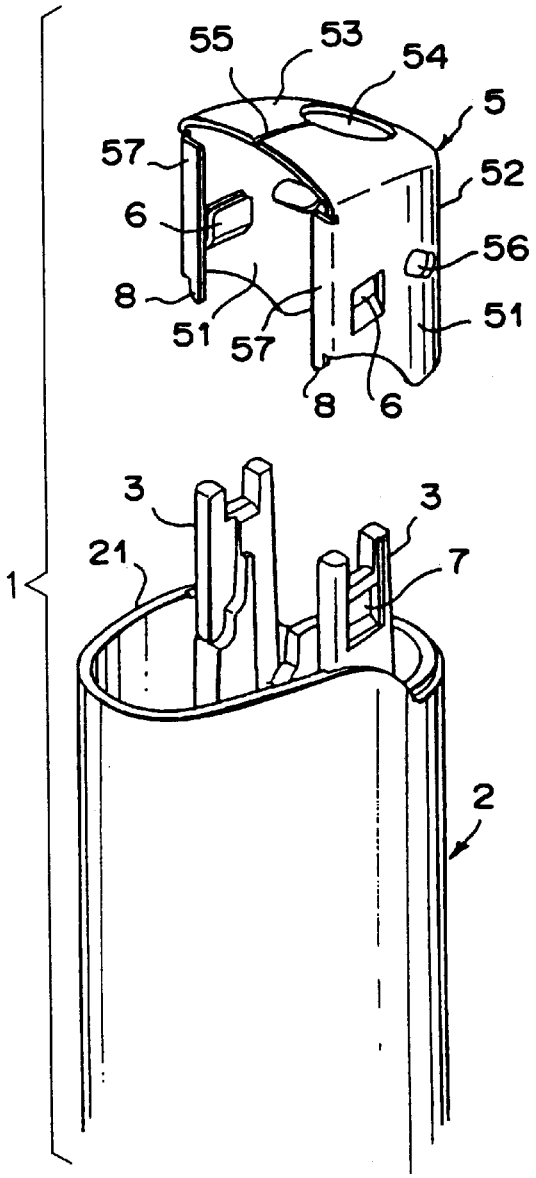
FIG. 1(A) is a perspective view of a lighter equipped with a structure for preventing detachment of the nozzle cap that is an embodiment of the invention, showing the nozzle cap positioned for attachment and, for ease of illustration, omitting the operation section and other members.
Figure 1B:
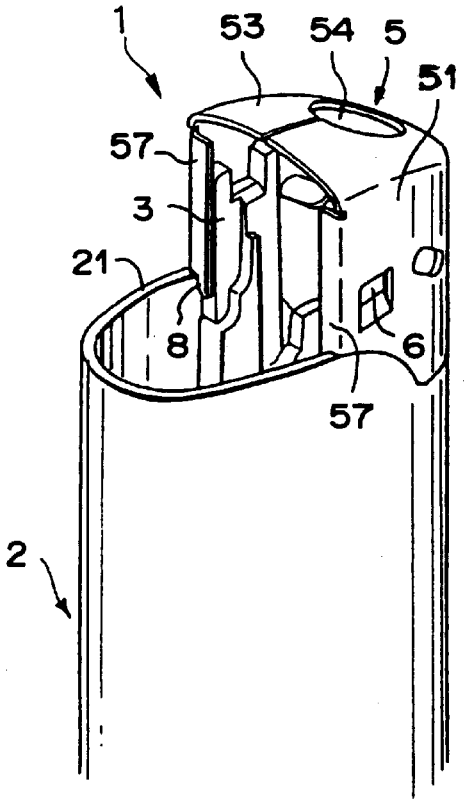
FIG. 1(B) is a perspective view similar to FIG. 1(B) showing the nozzle cap after attachment.

An embodiment of the invention will now be explained in detail with reference to the drawings. FIGS. 1(A) and 1(B) show the essential structure of a gas cigarette lighter having a structure for preventing detachment of the nozzle cap that is an embodiment of the invention. The operation member and other members are omitted from the drawing for ease of illustration. FIG. 1(A) shows the nozzle cap just before attachment and FIG. 1(B) shows it after attachment. FIGS. 2A–2C and 3A and 3B show the order of steps in the attachment process.

The basic structure of the lighter, designated by reference numeral 1, including the main lighter body 2, is the same as that of the conventional lighter. A nozzle is provided at the top front of the main lighter body 2 as a burner for producing a flame by burning jetted fuel gas. (The nozzle is hidden out of sight behind a post in the drawing.) A pair of posts 3, 3 are formed to extend upward from the top center of the main lighter body 2. Although not shown in the drawings, an operation member (operation cap) for effecting the operations required for lighting the burner is provided rearward of the posts 3, 3 to be vertically movable. A nozzle cap 5 is attached to cover a zone surrounding the nozzle, namely, to cover a zone extending from the front of the main lighter body 2 to the sides of the posts 3, 3.

The main lighter body 2 is made of plastic. It is equipped with a tank for storing a fuel gas such as butane gas, a conventional valve device for controlling the amount of stored fuel gas jetted, and the aforesaid nozzle, which is connected with the valve device and projects upward from the top surface of the main lighter body 2. The operation member is operated by pressing it downward. This first causes fuel gas to be jetted from the nozzle and then, with further downward movement, causes an igniter (a piezoelectric unit) to produce a spark discharge. A partition is installed at the position of the posts 3, 3 to isolate the nozzle from the operation member.

The structure for preventing detachment of the nozzle cap 5 will now be explained. The nozzle cap 5 is punched from a metal sheet with a punching machine to have a horseshoe shape. It has opposite side walls 51, 51 spaced by the width of the main lighter body 2 and running parallel to its outer side surfaces, a bowed front wall 52 connecting the side walls 51, 51 and a ceiling 53 forming the upper surface. It is open at the rear. The side walls 51, 51 are imparted with elasticity in the direction of narrowing the space between them and are fitted over the outer surfaces of the posts 3, 3 of the main lighter body 2.

The ceiling 53 forming the upper surface of the nozzle cap 5 extends from the upper ends of the side walls 51, 51 and the front wall 52 in an outwardly bent manner. The ceiling 53 is formed at its portion above the nozzle with a round flame hole 54 through which the flame rises. The middle portion of the ceiling 53 rearward of the flame hole 54 is formed with a ceiling gap 55 and is imparted with elasticity enabling spreading deformation. The side walls 51, 51 and the front wall 52 are formed with air holes 56.

The nozzle cap 5 is formed near the bottom of the side walls 51, 51 with inwardly projecting catches 6, 6. The lower portion of each side catch 6 forms an inclined surface 61 extending inward and upward from the portion where the catch 6 and the side wall 51 join. Its upper portion runs approximately parallel to the side wall 51. Its upper edge 62 extends fore and aft.

The outer surface of each post 3 of the main lighter body 2 is formed with a rectangular socket 7 for engagement by the associated catch 6 of the nozzle cap 5. The sockets 7, 7 are disposed to enable engagement between their roofs and the upper edges 62, 62 of the catches 6, 6. When this engagement is established, movement of the nozzle cap 5 in the upward and fore-aft directions is restricted.

The rear edges of the side walls 51, 51 of the nozzle cap 5 are bent inward to form inwardly projecting flanges 57, 57. The flanges 57, 57 are formed to lie along the rear surfaces of the posts 3, 3 of the main lighter body 2 and are provided at, their lower ends with downwardly extending retaining portions 8, 8. Since they extend downward, the retaining portions 8, 8 can engage with the inside of the upper end portion of the outer wall 21 of the main lighter body 2. One corner at the tip end of each retaining portion 8 is formed as an inclined surface 81.

The upper edge of the outer wall 21 is raised at the rear portion of the main lighter body 2. The retaining portions 8, 8 engage with the inner surface of the outer wall 21 near the top of this raised portion behind the posts 3, 3. This engagement prevents the side walls 51, 51 from spreading by deformation. The inner corner of the upper edge of the outer wall 21 at the portion engaged by the retaining portions 8, 8 is beveled to form a tapered surface 22.

Figure 2A:
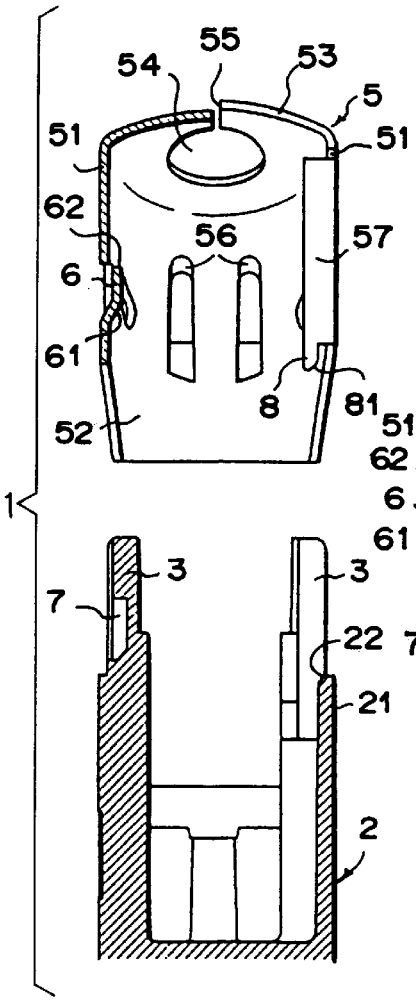
FIGS. 2A–2C are a set of side views of the essential portion showing in order the steps in the attachment of the nozzle cap shown in FIGS. 1A and 1B.
Figure 2B:
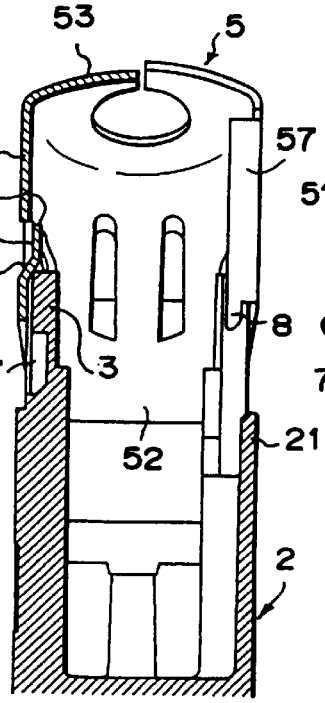
Figure 2C:
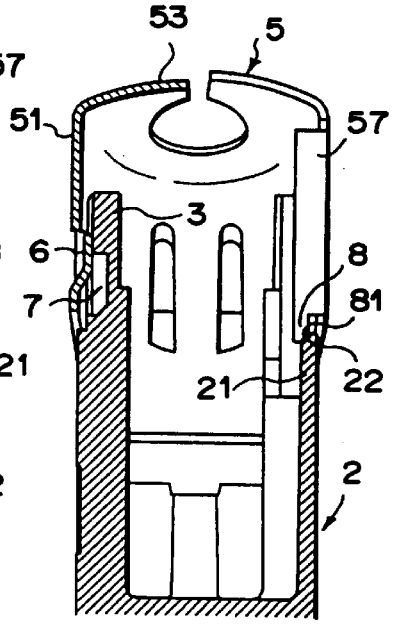

To attach the nozzle cap 5 to the top of the main lighter body 2, the nozzle cap 5 is first aligned with the main lighter body 2 as shown FIG. 2(A) and then moved downward so that the flanges 57, 57 at its rear end move along the rear surfaces of the posts 3, 3 until the inclined surfaces 61, 61 at the lower ends of the catches 6, 6 of the side walls 51, 51 of the nozzle cap 5 strike on the upper ends of the posts 3, 3 as shown in FIG. 2(B). The nozzle cap 5 is then pressed further downward to slide the inclined surfaces 61, 61 along the side surfaces of the posts 3, 3 while deforming and spreading the side walls 51, 51 outward slightly, thereby lowering the catches 6, 6 further along the side surfaces of the posts 3, 3 and, as shown in FIG. 2(C), bringing the inclined surfaces 81, 81 at the tips of the retaining portions 8, 8 of the flanges 57, 57 into contact with the tapered surface 22 at the inner corner of the upper edge of the main lighter body 2.

Figure 3A:
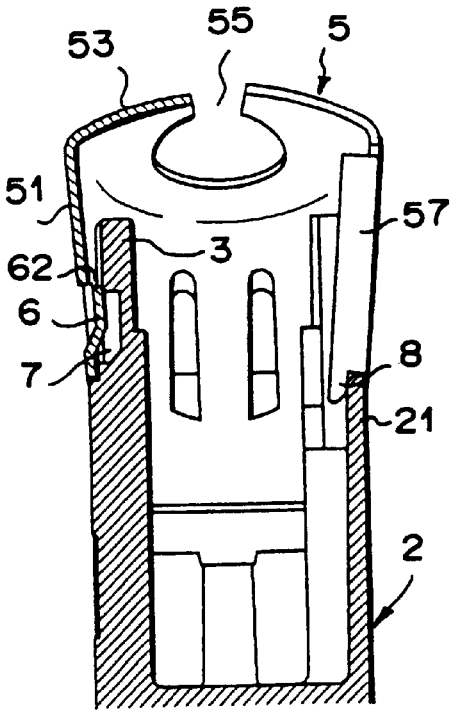
FIGS. 3A and 3B are a set of side views of the essential portion showing in order the remaining steps in the attachment of the nozzle cap shown in FIG. 1A and 1B .
Figure 3B:
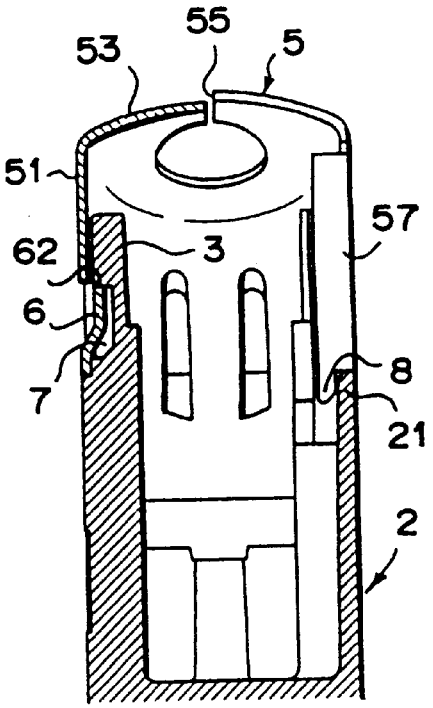

When depression of the nozzle cap 5 is continued, the ceiling gap 55 of the nozzle cap 5 widens to further deform and spread the upper portions of the side walls 51, 51 and enable the retaining portions 8, 8 to reach the inside of the outer wall 21 as shown in FIG. 3(A). Further downward pressing to the final stage shown in FIG. 3(B) causes the catches 6, 6 of the side walls 51, 51 to enter the sockets 7, 7 of the posts 3, 3, where they are retained by the inward elastic force of the side walls 51, 51, and reduces the outward deformation of the side walls 51, 51 so that the side walls 51, 51 align flush with outer side surface of the main lighter body 2. This completes the attachment.

In the assembled state, the nozzle cap 5 is prevented from further descent by abutment of the lower ends of the side walls 51, 51 on the main lighter body 2, is prevented from moving upward by engagement of the upper edges 62, 62 of the catches 6, 6 with the roofs of the sockets 7, 7, and is prevented from fore-aft movement by the engagement of the catches 6, 6 with the sockets 7, 7. In addition, sideways spreading deformation of the side walls 51, 51 of the lower end portions of the nozzle cap 5 is prevented by the engagement between the retaining portions 8, 8 and the upper end of the outer wall 21 of the main lighter body 2. Owing to these movement restrictions, the nozzle cap 5 is effectively prevented from detachment.

If a deforming force working to laterally spread the side walls 51, 51 should act on the nozzle cap 5, as may happen when the lighter 1 is dropped onto a hard surface, the engagement between the retaining portions 8, 8 and the upper inner edge of the outer wall 21 will prevent spreading of the side walls 51, 51, particularly spreading in the vicinity of the catches 6, 6. The catches 6, 6 will therefore be able to maintain their engagement with the sockets 7, 7 to provide a strong nozzle cap detachment preventing effect. Since the engaging locations of the retaining portions 8, 8 are not visible from the exterior, moreover, the nozzle cap 5 is difficult to detach even with a tool. An attempt to remove the nozzle cap 5 by spreading the lower ends of the side walls 51, 51 to release the engagement of the catches 6, 6 is thwarted by the engagement of the retaining portions 8, 8 with the upper inner edge of the outer wall 21. If force is used, the gas cigarette lighter 1 will break. Tampering with the lighter such as by removing the nozzle cap 5 and changing the nozzle mechanism adjustment is thus made impossible.

While an embodiment was explained with respect to a lighter equipped with a piezoelectric unit, the invention can also be applied to a lighter lit by sparks produced by friction between a flint and a striker wheel rotatably supported by bearings provided on the posts 3, 3.

Further, the retaining portions 8, 8 of the nozzle cap 5 need not necessarily be provided at the lower ends of the flanges 57, 57 as in the foregoing embodiment, but can be provided at any location where they are capable of engaging the upper inner edge the main lighter body 2. They can, for example, be provided as extensions directly from the bottoms of the side walls 51, 51. As regards the engagement between the catches 6, 6 of the nozzle cap 5 and the sockets 7, 7 of the main lighter body 2, moreover, the shape of the inclined surfaces and the relationship between the catches and the sockets can be variously modified in line with the design requirements of different embodiments.

What is claimed is:

1. A structure for preventing detachment of a lighter nozzle cap in a lighter nozzle cap in a lighter including a main lighter body and a nozzle cap for covering a zone surrounding a burner from above, the structure comprising:

a pair of posts projecting from the top of the main lighter body, each post being formed with a socket, a pair of detachment preventing catches provided one on either side wall of the nozzle cap to be engageable with the sockets, and retaining portions provided at portions of the side walls for engaging with an upper inner edge of the main lighter body to prevent spreading deformation of the side walls.

2. A structure according to claim 1, wherein the nozzle cap is attached to the top of the main lighter body by bringing the retaining portions on the side walls of the nozzle cap into engagement with the upper inner edge of the main lighter body and then deforming and spreading the walls of the nozzle cap to bring the catches into engagement with the sockets.

3. A structure according to claim 1 or 2, wherein edges of the side walls of the nozzle cap are bent to form inwardly projecting flanges and the retaining portions are provided at lower ends of the flanges to extend downward inside an upper end of the main lighter body, engagement between the retaining portions and the upper inner edge of the main lighter body preventing spreading deformation of the nozzle cap.

* * * * *

UNITED STATES PATENT AND TRADEMARK OFFICE

CERTIFICATE OF CORRECTION

PATENT NO. : 6,106,280
DATED : August 22, 2000
INVENTOR(S) : M. Kanno et al.

It is certified that error appears in the above-identified patent and that said Letters Patent is hereby corrected as shown below:

Title page,
Item [56] References Cited, U.S. PATENT DOCUMENTS insert
-- 3,328,980 7/1967 Reim --.

Claims,
Column 5,
Line 23, delete -- in a lighter nozzle cap --.

Signed and Sealed this

Thirteenth Day of November, 2001

*Attest:*

Nicholas P. Godici

*Attesting Officer*

NICHOLAS P. GODICI
*Acting Director of the United States Patent and Trademark Office*